US005630234A

United States Patent [19]

Childs

[11] Patent Number: 5,630,234

[45] Date of Patent: May 20, 1997

[54] BIDET ASSEMBLY

[76] Inventor: Jack D. Childs, 6353 Green Rd., Woodridge, Ill. 60517

[21] Appl. No.: 520,103

[22] Filed: Aug. 28, 1995

[51] Int. Cl.[6] ..... A47K 3/20

[52] U.S. Cl. ..... 4/420.4; 4/444

[58] Field of Search ..... 4/420.1–420.5, 4/443–448

[56] References Cited

U.S. PATENT DOCUMENTS

| | | | |
|---|---|---|---|
| 2,053,594 | 9/1936 | Albert | 119/1 |
| 2,080,438 | 5/1937 | Salvori | 4/445 X |
| 2,139,951 | 12/1938 | Gaston et al. | 4/6 |
| 2,872,686 | 2/1959 | Osborn et al. | 4/6 |
| 3,082,432 | 3/1963 | Pearlman | 4/7 |
| 3,781,919 | 1/1974 | Ayala | 4/7 |
| 3,808,608 | 5/1974 | Caplan | 4/7 |
| 3,812,543 | 5/1974 | Stinson | 4/7 |
| 3,947,898 | 4/1976 | Ducharme | 4/6 |
| 3,995,326 | 12/1976 | Umann | 4/7 |
| 4,041,553 | 8/1977 | Sussman | 4/7 |
| 4,087,868 | 5/1978 | Gentz | 4/7 |
| 4,092,744 | 6/1978 | Butoi | 4/7 |
| 4,123,807 | 11/1978 | Oguma et al. | 4/7 |
| 4,123,808 | 11/1978 | Guarrera | 4/7 |
| 4,135,255 | 1/1979 | Menendez | 4/7 |
| 4,136,407 | 1/1979 | Maurer | 4/7 |
| 4,197,594 | 4/1980 | Butterfield | 4/7 |
| 4,205,402 | 6/1980 | Miller | 4/448 |
| 4,242,764 | 1/1981 | Fukuda | 4/420 |
| 4,259,754 | 4/1981 | Bader et al. | 4/443 |
| 4,287,618 | 9/1981 | Silver | 4/443 |
| 4,334,329 | 6/1982 | Miyanaga | 4/443 |
| 4,340,980 | 7/1982 | Fushimi et al. | 4/448 |
| 4,370,764 | 2/1983 | Ando et al. | 4/443 |
| 4,383,339 | 5/1983 | Miller | 4/448 |
| 4,389,738 | 6/1983 | Ando et al. | 4/420 |
| 4,391,004 | 7/1983 | Kawai et al. | 4/443 |
| 4,406,025 | 9/1983 | Huck et al. | 4/443 |
| 4,422,189 | 12/1983 | Couvrette | 4/420 |
| 4,441,219 | 4/1984 | Epstein | 4/448 |
| 4,451,942 | 6/1984 | Hirano et al. | 4/420 |
| 4,550,454 | 11/1985 | Yui | 4/420 |
| 4,551,867 | 11/1985 | Gurevich et al. | 4/420 |
| 4,553,274 | 11/1985 | Yui | 4/420 |
| 4,558,473 | 12/1985 | Morikawa et al. | 4/420 |
| 4,596,058 | 6/1986 | Nourbakhsh | 4/448 |
| 4,628,548 | 12/1986 | Kurosawa et al. | 4/420 |
| 4,638,514 | 1/1987 | Landsberger | 4/239 |
| 4,807,311 | 2/1989 | Ingels | 4/443 |
| 4,850,060 | 7/1989 | Kou | 4/237 |
| 4,924,534 | 5/1990 | Basile | 4/447 |
| 4,926,509 | 5/1990 | Bass | 4/448 |
| 4,967,423 | 11/1990 | Aoyama | 4/420 |
| 4,995,121 | 2/1991 | Barker | 4/443 |
| 5,101,520 | 4/1992 | Lockhart | 4/447 |
| 5,138,726 | 8/1992 | Campbell | 4/420 |
| 5,210,885 | 5/1993 | Ruo | 4/420 |

(List continued on next page.)

FOREIGN PATENT DOCUMENTS

| | | | |
|---|---|---|---|
| 0601140 | 4/1926 | France | 4/444 |
| 0052613 | 3/1987 | Japan | 4/420.4 |
| 3293436 | 12/1991 | Japan | 4/444 |
| 4055533 | 2/1992 | Japan | 4/444 |
| 5064621 | 3/1993 | Japan | 4/447 |

*Primary Examiner*—Charles E. Phillips
*Attorney, Agent, or Firm*—Chernoff, Vilhauer, McClung & Stenzel

[57] ABSTRACT

A bidet assembly for use with a toilet having a toilet seat is disclosed. The bidet assembly provides a bidet seat to be coupled rotatably to the toilet to be movable between a raised position and a lowered position over the toilet seat on the toilet bowl. The bidet seat defines a central opening. A nozzle for providing a fluid flow therethrough is connected to the bidet peat proximate the central opening. The nozzle is thus movable with the bidet seat when the bidet seat is coupled to the toilet. When coupled to a conventional toilet, the bidet seat is rotated into position atop the toilet seat only when the user wishes to use the bidet assembly. Thus, the bidet nozzle and any attached water supply are protected from contamination by the toilet. When the bidet assembly is not in use, the bidet seat is rotated to a raised position.

3 Claims, 3 Drawing Sheets

U.S. PATENT DOCUMENTS

| | | | |
|---|---|---|---|
| 5,253,373 | 10/1993 | Tsipov | 4/343 |
| 5,263,205 | 11/1993 | Leunissen | 4/420 |
| 5,271,104 | 12/1993 | LaTora | 4/420 |
| 5,279,001 | 1/1994 | Vento | 4/447 |
| 5,287,566 | 2/1994 | Azada | 4/420 |
| 5,331,692 | 7/1994 | Alberti | 4/445 |
| 5,359,736 | 11/1994 | Olivier | 4/448 |
| 5,361,427 | 11/1994 | Wilk | 4/420 |
| 5,369,817 | 12/1994 | Iguchi | 4/448 |
| 5,384,919 | 1/1995 | Smith | 4/448 |

BIDET ASSEMBLY

BACKGROUND OF THE INVENTION

The present invention relates to a bidet, and more particularly, to a bidet assembly for use on a toilet.

A conventional bidet is used for bathing the external genitals and the posterior parts of the body. Such a bidet is a free-standing fixture that requires additional bathroom floor space. In order to conserve space, yet still provide a cleansing spray for the genital and anal area of the body, several devices incorporate a spray nozzle into an existing toilet. Most of these devices attach the spray nozzle beneath an existing toilet seat.

Vento, U.S. Pat. No. 5,279,001, describes a toilet seat that includes a hollow channel with a pair of fluid flow activated, pop-out cleansing spouts. Yui, U.S. Pat. No. 4,553,274, discloses a toilet seat with an added pivoting spray-arm which is stored between the toilet bowl rim and a channel molded into the base of the seat. Such toilet seat assemblies have nozzles which are easily contaminated because they are exposed to the toilet bowl when the toilet is being used. Furthermore, such devices interfere with normal cleaning of the toilet.

Wilk, U.S. Pat. No. 5,361,427, discloses a portable bidet that is disposable on a toilet bowl rim or toilet seat for use of the bidet. Such portable devices, however, require additional and separate storage space when not in use.

The object of this invention is to provide a bidet assembly that is convenient to use, that is economical and that is easily installed on an existing toilet.

SUMMARY OF THE INVENTION

The problems of the prior known bidets are solved by the present invention which provides a bidet assembly for use with a toilet having a toilet bowl and a toilet seat. The bidet assembly is a bidet seat to be coupled rotatably to the toilet to be movable between a raised position and a lowered position over the toilet seat on the toilet bowl. The bidet seat defines a central opening. A nozzle for providing a fluid flow therethrough is connected to the bidet seat proximate the central opening. The nozzle is thus movable with the bidet seat when the bidet seat is coupled to the toilet. The bidet assembly is coupled to a conventional toilet, and the bidet seat is rotated into position atop the toilet seat only when the user wishes to use the bidet assembly. Thus, the bidet nozzle and any attached water supply are protected from contamination by the toilet. When the bidet assembly is not in use, the bidet seat is rotated to a raised position.

In a preferred embodiment, the nozzle has an inlet end and an outlet end and a fluid flow passage interconnecting these ends. A fluid supply line has a first end connected in fluid communication to the inlet end of the nozzle and a second end to be connected in fluid communication to a source of fluid under pressure. A flow control valve is operatively connected to the fluid supply line for controlling fluid flow through the line. The nozzle is connected to the bidet seat proximate the rear of the toilet bowl and directs a gentle arc of water toward the center of the central opening in the bidet seat. The user may thus choose to straddle or sit astride the bidet seat facing in either direction as is most convenient for cleansing the body.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
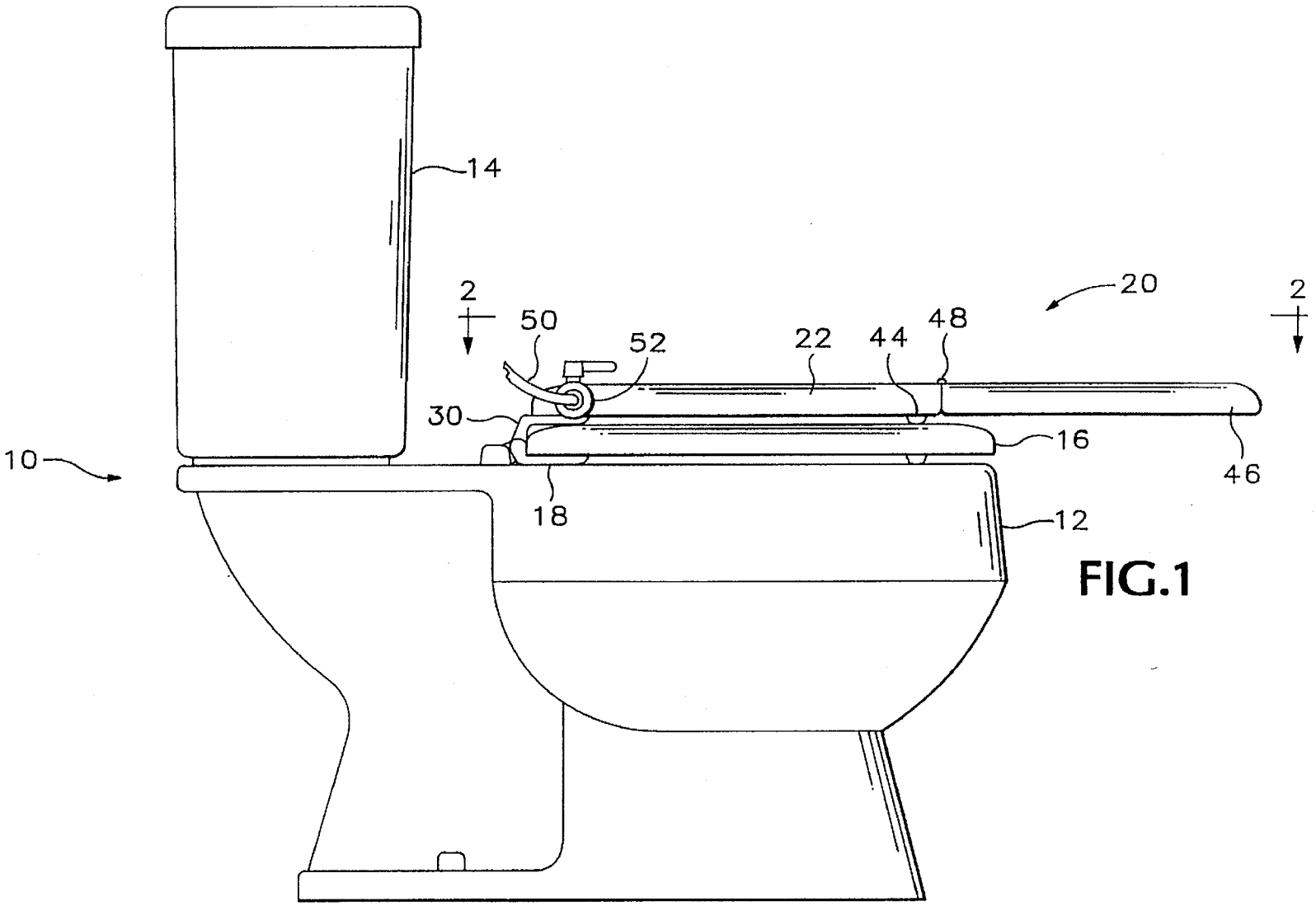
FIG. 1 is a side elevational view of a conventional toilet with a bidet assembly embodying the present invention shown in a lowered position.
Figure 3:
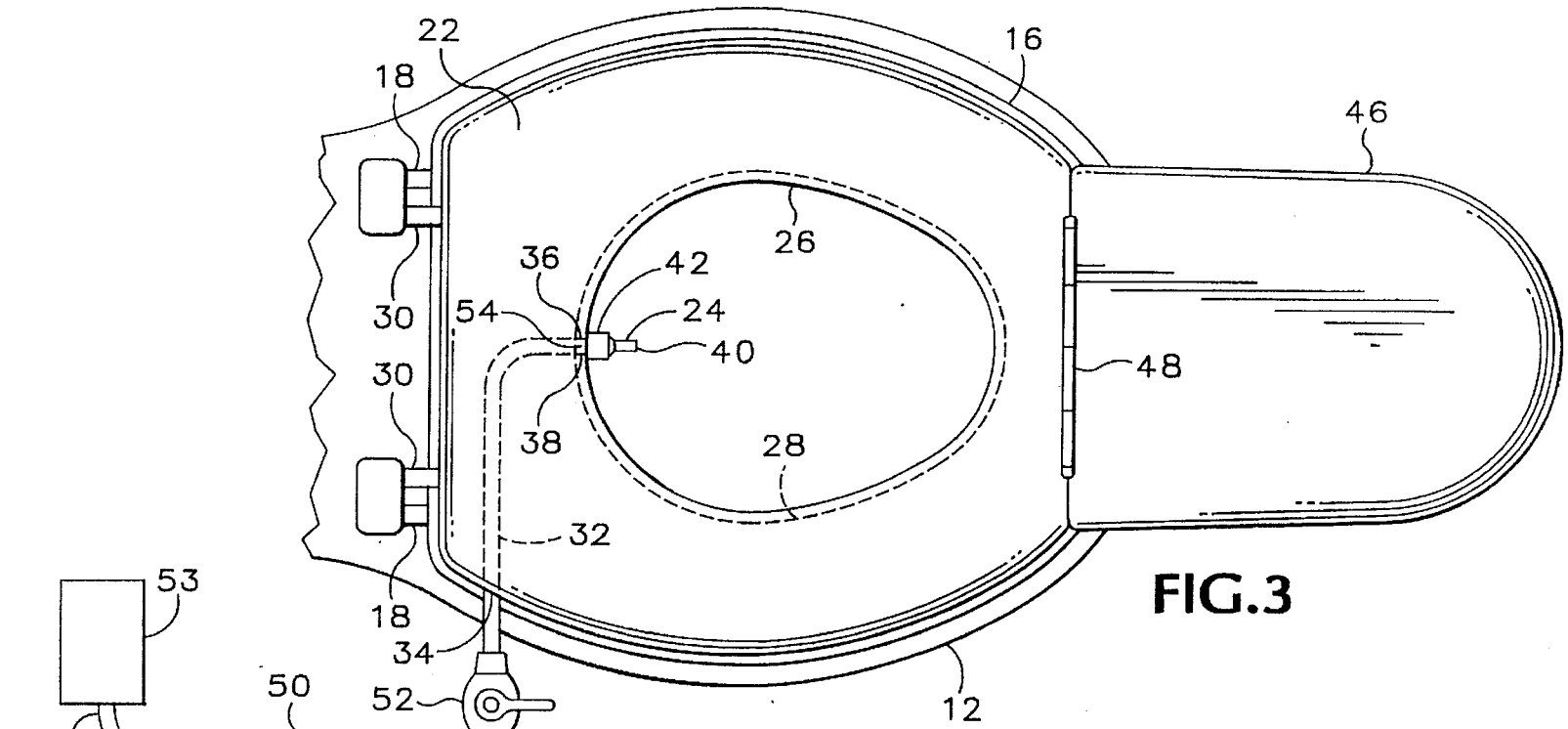
FIG. 3 is an enlarged top plan view of the bidet assembly of FIG. 1 shown with a portion of the assembly in phantom and a portion of the toilet broken away.
Figure 2:
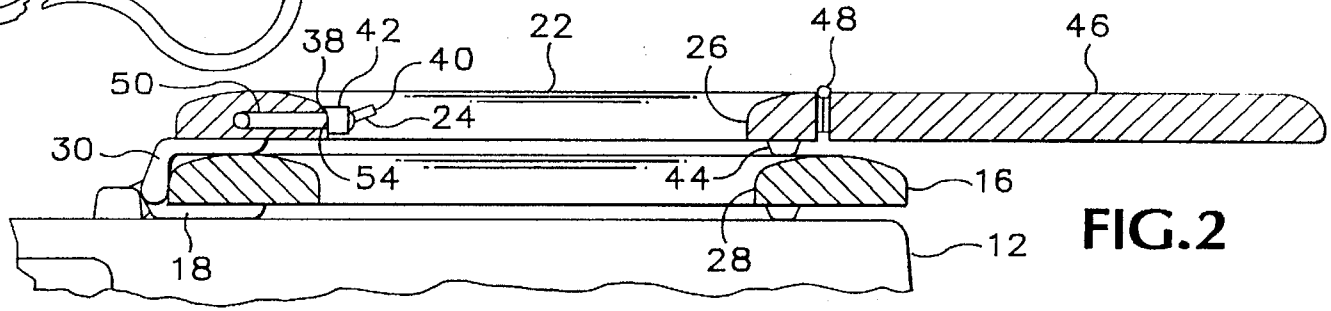
FIG. 2 is an enlarged sectional view of the bidet assembly taken along line 2—2 of FIG. 1 shown with the toilet broken away.
Figure 4:
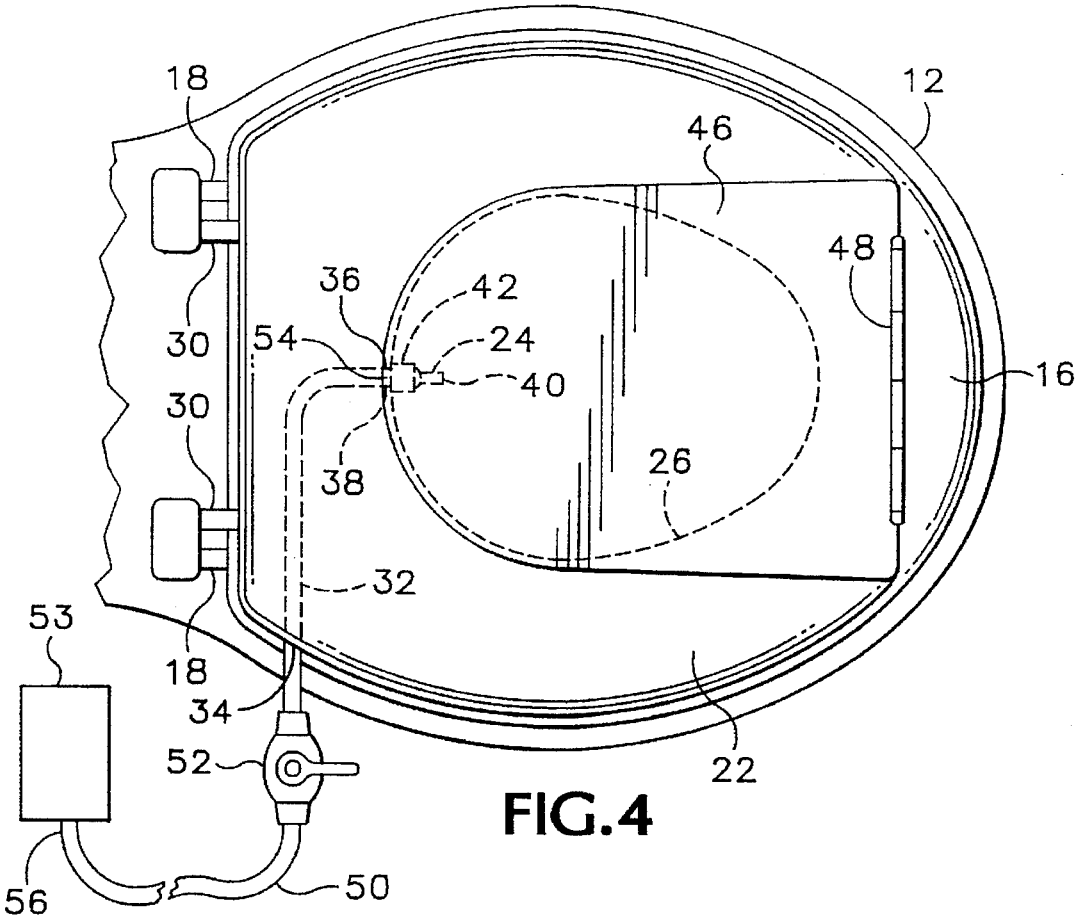
FIG. 4 is a top plan view of the bidet assembly of FIG. 3 shown with the cover portion closed.
Figure 5:
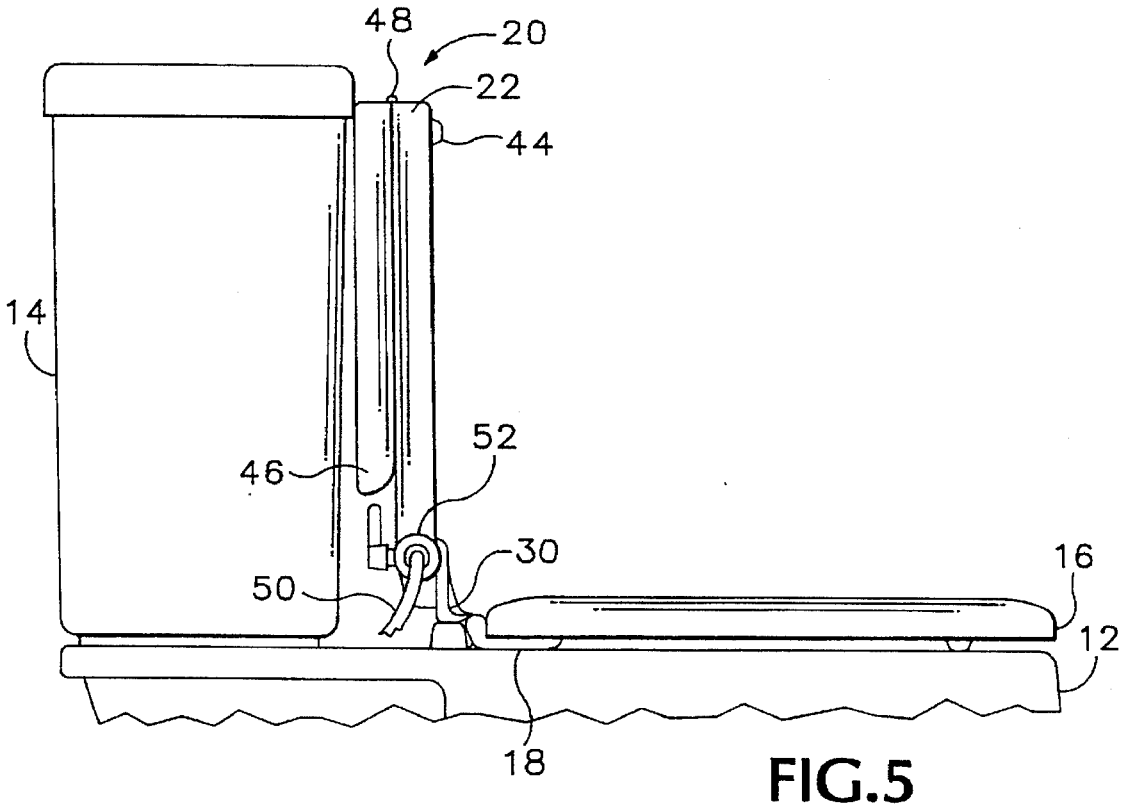
FIG. 5 is a side elevational view of the bidet assembly of FIG. 1 shown in a raised position with a portion of the toilet broken away.

Referring now to an exemplary embodiment illustrated in FIGS. 1–5, a bidet assembly 20 is rotatably coupled to a conventional toilet 10 that includes a toilet bowl 12, a toilet tank 14, and a toilet seat 16 attached to the bowl by a hinge 18. The bidet assembly 20 includes a bidet seat 22 and a nozzle 24. The bidet seat 22 defines a central opening 26 that is generally oval in shape and generally smaller than the opening 28 in the toilet seat 16. The bidet seat 22 is attached to the bowl 12 by a hinge 30 so that the bidet seat is rotatable between a raised position (FIG. 5) and a lowered position over the toilet seat 16.

The bidet seat 22 includes an upper seat portion and a lower base portion which are attached to one another to define a hollow channel 32 therebetween. The hollow channel 32 provides a fluid flow passage from an inlet end 34 to an outlet end 36 in the central opening 26 of the bidet seat 22 proximate the rear of the toilet bowl 12. Although not shown, it will be noted that, if desired, the channel 32 may extend along the side of the bidet seat 22 and around the central opening 26 to terminate at an outlet end in the central opening proximate the front of the toilet bowl 12. The outside bottom of the lower base portion of the bidet seat 22 is generally flat (FIG. 5) so that a person may, if he or she wishes, comfortably lean against the bidet seat 22 in its raised position. A foot 44 is attached to the lower base portion of the bidet seat 22 to ensure that the seat is level when lowered into position on the toilet seat 16 (FIG. 1). A cover 46 is connected to the bidet seat 22 by a hinge 48, which, together with the hinges 18 and 30, is capable of supporting a cantilevered weight on the cover, such as the weight of a user.

The nozzle 24 is attached to the bidet seat 22 at the outlet end 36 of the hollow channel 32. The nozzle 24 has an inlet end 38 and an outlet end 40 and includes a ball joint 42 which permits directional control of the outlet end of the nozzle.

A fluid supply line 50 with a flow control valve 52 interconnects a source 53 of fluid under pressure and the nozzle 24. The hollow channel 32 in the bidet seat 22 receives therein the fluid supply line 50. As shown, a first end 54 of the fluid supply line 50 terminates at the nozzle 24 at the outlet end 36 of the hollow channel 32. Alternatively, the inlet 34 and outlet ends 36 of the channel may be tapped to make appropriate fluid connections with the fluid supply line 50 and the nozzle 24, respectively, so that the nozzle is in fluid communication with the first end 54 of the fluid supply line. The second end 56 of the fluid supply line 50 is connected to the fluid source 53. The fluid source 53 may be any convenient source of pressurized fluid such as an existing sink, shower or tub, or a separate installation. The source preferably provides warm water. The fluid flow control valve 52 is operatively connected to the fluid supply line 50.

To use the bidet assembly 20 the bidet seat 22 is rotated from a raised position (FIG. 5) to a lowered position on the toilet seat 16 and the cover 46 is pivoted open. The bidet assembly user may, if desired, sit initially on the cover 46 and, with body weight supported, swing one leg over the bidet seat 22 in order to face the nozzle 24. The user activates the flow control valve 52 to permit fluid, such as warm water, to flow through the fluid supply line and out the nozzle 24 in a gentle arc. The user may change the position of the outlet end 40 of the nozzle 24 to direct the cleansing fluid flow as desired. The bottom and the edges of the central opening 26 in the bidet seat 22 are drip resistant and, because the central opening 26 is smaller than the opening 28 in the toilet seat 16, the toilet seat remains dry when the bidet assembly is in use.

The bidet assembly and a toilet seat may be manufactured as a unit which will replace the toilet seat and cover of a conventional toilet. It will also be noted that the bidet assembly of the present invention may be constructed to conform to any shape toilet bowl, such as an elongated toilet bowl, as well as to a standard toilet bowl.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A bidet assembly for use with a toilet having a toilet bowl and a toilet seat, comprising:

(a) a bidet seat to be coupled rotatably to said toilet to be moveable between a raised position and a lowered position over said toilet seat on said toilet bowl, said bidet seat defining a central opening;

(b) a nozzle for providing a fluid flow therethrough, said nozzle being connected to said bidet seat proximate said central opening, said nozzle being moveable with said bidet seat when said bidet seat is rotatably coupled to said toilet; and (c) said bidet seat including an upper seat portion and a lower base portion, said upper and lower portions being attached to one another, said nozzle having an inlet end, an outlet end and a fluid flow passage interconnecting said inlet and outlet ends, said nozzle being connected to said lower base portion of said bidet seat, said outlet end of said nozzle being directed upward toward the center of said central opening.

2. A bidet assembly for use with a toilet having a toilet bowl and toilet seat, comprising:

(a) a bidet seat to be coupled rotatably to said toilet to be moveable between a raised position and a lowered position over said toilet seat on said toilet bowl, said bidet seat defining a central opening;

(b) a nozzle for providing a fluid flow therethrough, said nozzle being connected to said bidet seat proximate said central opening, said nozzle being moveable with said bidet seat when said bidet seat is rotatably coupled to said toilet;

(c) said nozzle having an inlet end, an outlet end and a fluid flow passage interconnecting said inlet and outlet ends, said bidet assembly further including a fluid supply line having a first end connected in fluid communication to said inlet end of said nozzle and a second end connectable in fluid communication to a source of fluid under pressure; and (d) said bidet seat includes an upper seat portion and a lower base portion, said upper and lower portions being attached to one another to define a hollow channel therebetween, said hollow channel having an inlet end, an outlet end and a fluid flow passage interconnecting said inlet end and said outlet end, said hollow channel comprising at least a portion of said fluid supply line.

3. The bidet assembly of claim 2 wherein said inlet end of said nozzle is connected in fluid communication to said outlet end of said hollow channel.

* * * * *

UNITED STATES PATENT AND TRADEMARK OFFICE

CERTIFICATE OF CORRECTION

PATENT NO. : 5,630,234

DATED : May 20, 1997

INVENTOR(S) : Jack D. Childs

It is certified that error appears in the above-indentified patent and that said Letters Patent is hereby corrected as shown below:

ABSTRACT, line 7 Change "peat" to --seat--.

Signed and Sealed this

Fourth Day of November, 1997

*Attest:*

*Attesting Officer*

BRUCE LEHMAN

*Commissioner of Patents and Trademarks*